United States Patent [19]

Dearling

[11] 4,248,059

[45] Feb. 3, 1981

[54] REVERSIBLE-CYCLE CLOSED-CIRCUIT REFRIGERATION SYSTEMS

[75] Inventor: Roy P. Dearling, Worcester Park, England

[73] Assignees: Kenneth Fowler; Edward Glover, both of England

[21] Appl. No.: 954,755

[22] Filed: Oct. 26, 1978

[30] Foreign Application Priority Data

Oct. 29, 1977 [GB] United Kingdom ..... 45162/77

[51] Int. Cl.[3] ..... F25B 13/00; F25B 27/02

[52] U.S. Cl. ..... 62/324 D; 62/238 E

[58] Field of Search ..... 62/160, 196 B, 196 R, 62/324 R, 324 D, 238 E

[56] References Cited

U.S. PATENT DOCUMENTS

| | | | |
|---|---|---|---|
| 2,751,761 | 6/1956 | Borgerd | 62/324 D |
| 3,188,829 | 6/1965 | Siewert et al. | 62/324 D |
| 3,301,002 | 1/1967 | McGrath | 62/324 D |
| 3,916,638 | 11/1975 | Schmidt | 62/238 E |
| 4,142,381 | 3/1979 | Lavigne, Jr. | 62/115 X |
| 4,146,089 | 3/1979 | Mueller et al. | 62/238 E |

OTHER PUBLICATIONS

*Electrical West,* vol. 66, No. 4, Apr. 1, 1931, pp. 177–179, W. R. Chawner, "2 Mill Commercial Heat by Refrigeration Cycle."

*Primary Examiner*—Lloyd L. King

*Attorney, Agent, or Firm*—Leydig, Voit, Osann, Mayer & Holt, Ltd.

[57] ABSTRACT

Reversible-cycle closed-circuit refrigeration systems such as used in air conditioning units generally include first and second heat exchangers for transferring heat between a refrigerant and first and second fluids respectively, the systems being operative to transfer heat from the first fluid to the second and from the second fluid to the first via the refrigerant. The necessary work input is provided by a compressor. To enable the first and second heat exchangers to operate at maximum efficiency during heat transfer between the fluids in both directions, a further heat exchanger is provided which is operative only during heat transfer in one direction. This further exchanger compensates for the imbalance in heat flows in the two directions due to the heat of compression.

6 Claims, 5 Drawing Figures

REVERSIBLE-CYCLE CLOSED-CIRCUIT REFRIGERATION SYSTEMS

BACKGROUND OF THE INVENTION

1. Field of the Invention

This invention relates to reversible-cyle closed circuit refrigeration systems and in particular, but not exclusively, to air-conditioning units.

2. Description of the Prior Art

A reversible-cycle closed-circuit refrigeration system generally includes first and second heat exchangers for transferring heat between a refrigerant and first and second fluids respectively, the system being operative selectively to transfer heat from the first fluid to the second and from the second fluid to the first via the refrigerant.

The refrigeration system also includes a compressor which does work on the refrigerant. As a consequence of the heat of compression imparted to the refrigerant, the ratio of the amount of heat transferred through each heat exchanger will depend on the direction of overall heat transfer by the system. As a result, the heat exchangers cannot be designed for optimum operation in both directions of overall heat transfer.

It is therefore an object of the invention to provide an improved reversible-cycle refrigeration system in which the heat exchangers can be operated at maximimum efficiency in both heat transfer directions.

SUMMARY OF THE INVENTION

According to the present invention, a refrigeration system is provided with means operative during transfer of heat from the first fluid to the second via the refrigerant to return heat from the refrigerant to the first fluid whereby to enable the efficiency of the system to be optimised for heat transfer in both directions between the first and second fluids.

The invention can be advantageously applied to reversible air-conditioning units built around a refrigeration system arranged to transfer heat between air to be conditioned and a water circuit. Such a refrigeration system comprises an air/refrigerant heat exchanger, a compressor, a water circuit/refrigerant heat exchanger and expansion means all serially interconnected in that order. In addition, the system comprises a second water circuit/refrigerant heat exchanger operative during air-heating to return heat to the water circuit and thereby optimise the efficiency of the unit.

BRIEF DESCRIPTION OF THE DRAWINGS

Two forms of a reversible-cycle air-conditioning unit embodying the invention will now be particularly described, by way of example, with reference to the accompanying drawings, in which.

DESCRIPTION OF THE PREFERRED EMBODIMENTS

Figure 1:
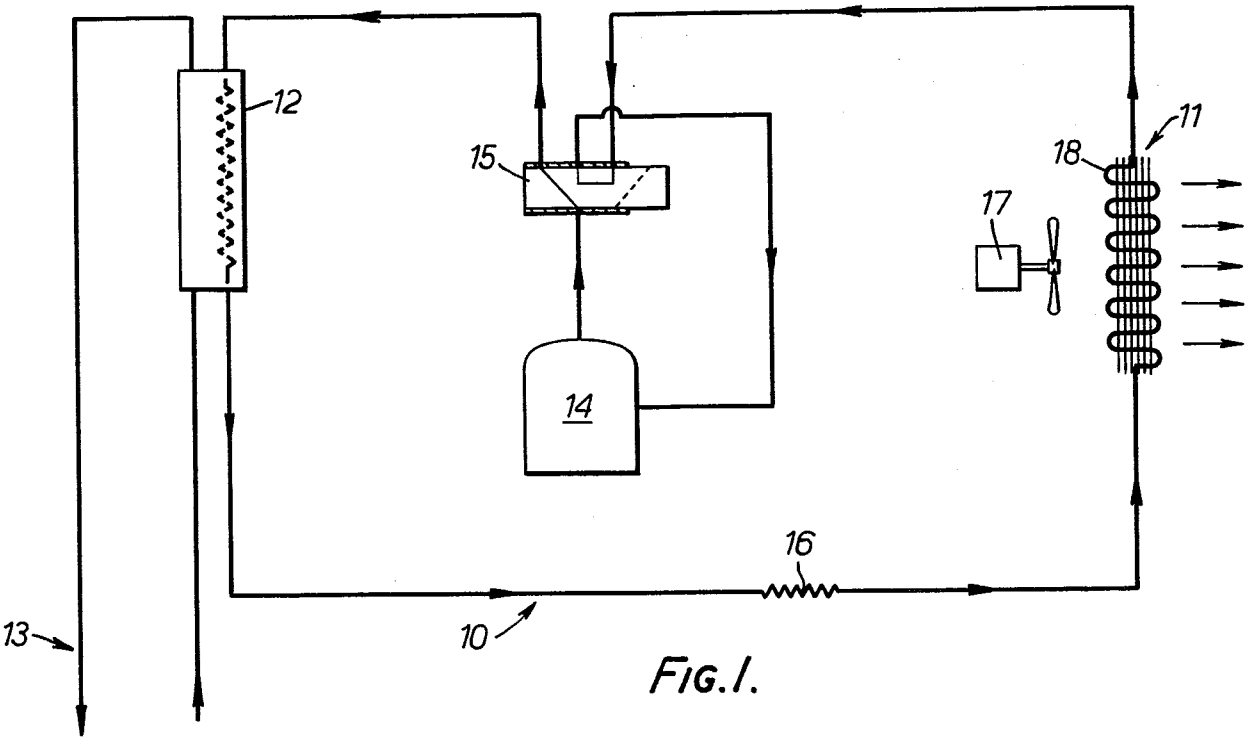
FIG. 1 is a diagram of a previously-proposed form of air-conditioning unit operating in an air-cooling mode.

Shown in FIG. 1 is an air-conditioning unit made in the form of a reversible, closed-cycle refrigeration system 10 comprising a first heat exchanger 11 for cooling or heating air to be conditioned, and a second heat exchanger 12 through which refrigerant of the system 10 can exchange heat with a water circuit 13. The refrigeration system also includes a compressor 14, a flow-reversing valve 15, a capillary expansion tube 16, and a fan 17 for passing air over the refrigerant coil 18 of the heat exchanger 11.

In operation of the air-conditioning unit in an air-cooling mode, the valve 15 is set to cycle refrigerant through the system 10 in the direction indicated by the arrows in FIG. 1. Thus, refrigerant is compressed by the compressor 14 (which simultaneously raises the temperature of the refrigerant) and the refrigerant is then passed through the water/refrigerant heat exchanger 12 which acts as a water-cooled condenser with water of the water circuit 13 removing heat from the refrigerant. The refrigerant is then expanded in the capillary expansion tube 16 to lower both its temperaure and pressure prior to passing through the coil 18 of the air/refrigerant heat exchanger 11. Air blown over the coil 18 by the fan 17 is cooled by the refrigerant. The refrigerant then returns to the compressor 14 via the valve 15 to be recompressed. Typical operating temperatures for the water circuit 13 are water in at 75° F. and out at 95° F. with air being cooled from 70° F. to 50° F.

In general terms it can be seen that both the heat absorbed by the refrigerant from the air through the heat exchanger 11 and the heat of compression (that is, the heat equivalent of the work done on the refrigerant by the compressor 14) are rejected to the water circuit 13. The components of the system 10 can be matched to give maximum efficiency for such a mode of operation of the system 10.

To operate the air-conditioning unit in an air-heating mode the valve 15 is set to cycle refrigerant through the system 10 in the direction opposite to that indicated by the arrows in FIG. 1. The refrigerant now loses heat to the air to be conditioned through the heat exchanger 11 which acts as an air-cooled condenser. The refrigerant receives heat from water circulated through the heat exchanger 12. Typical operating temperatures for the water circuit are water in at 75° F. and out at 62° F. with air being heated from 68° F. to 115° F.

If the components of the system 10 have been matched to give maximum efficiency during the air-cooling mode of operation then during the air-heating mode the water/refrigerant heat exchanger 12 will be over-sized whereas the air/refrigerant heat exchanger 11 will be under-sized, this being due to the heat of compression having now to be rejected by the exchanger 11 instead of the exchanger 12. As a result, the efficiency of the system 10 is reduced during its air-heating mode of operation.

Figure 2:
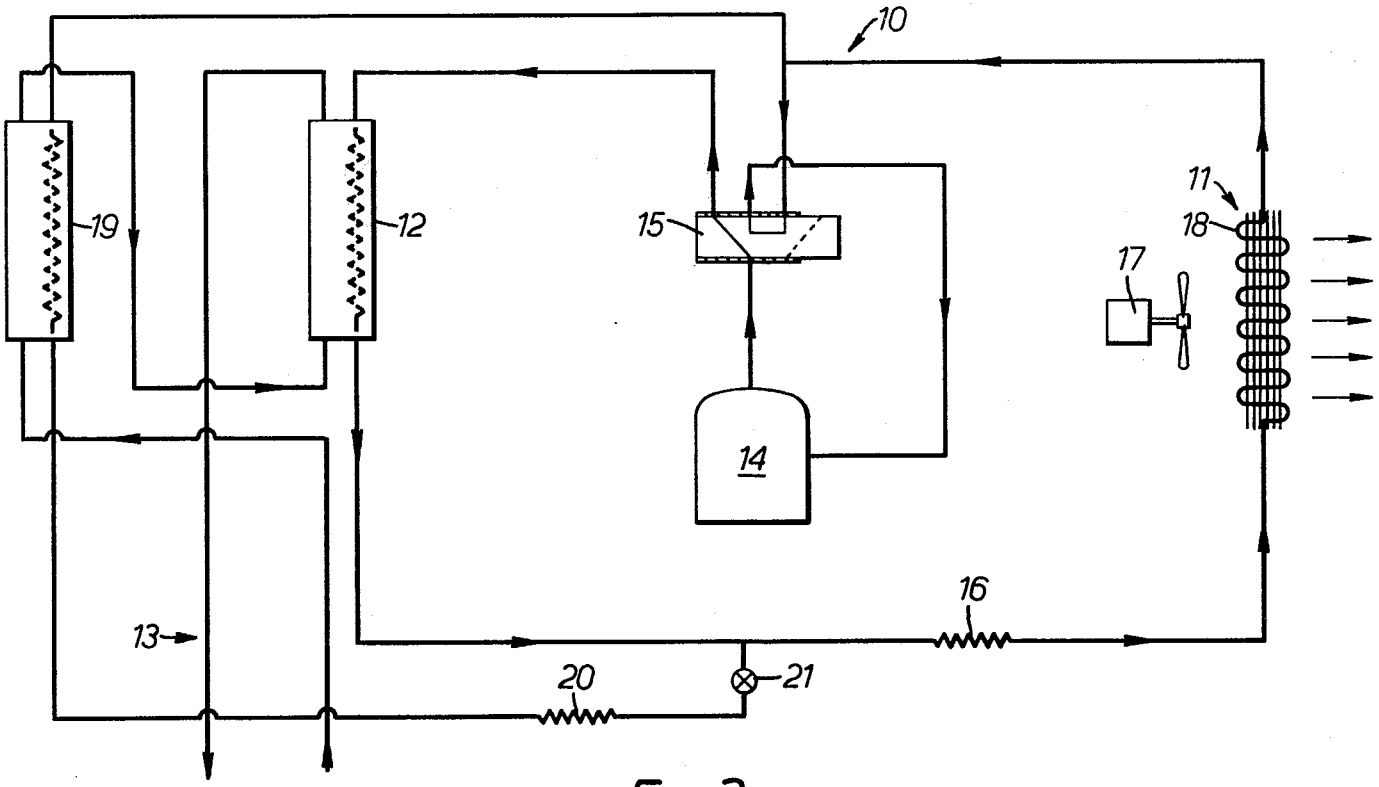
FIG. 2 is a diagram of a first form of the air-conditioning unit embodying the invention, operating in an air-cooling mode.
Figure 3:
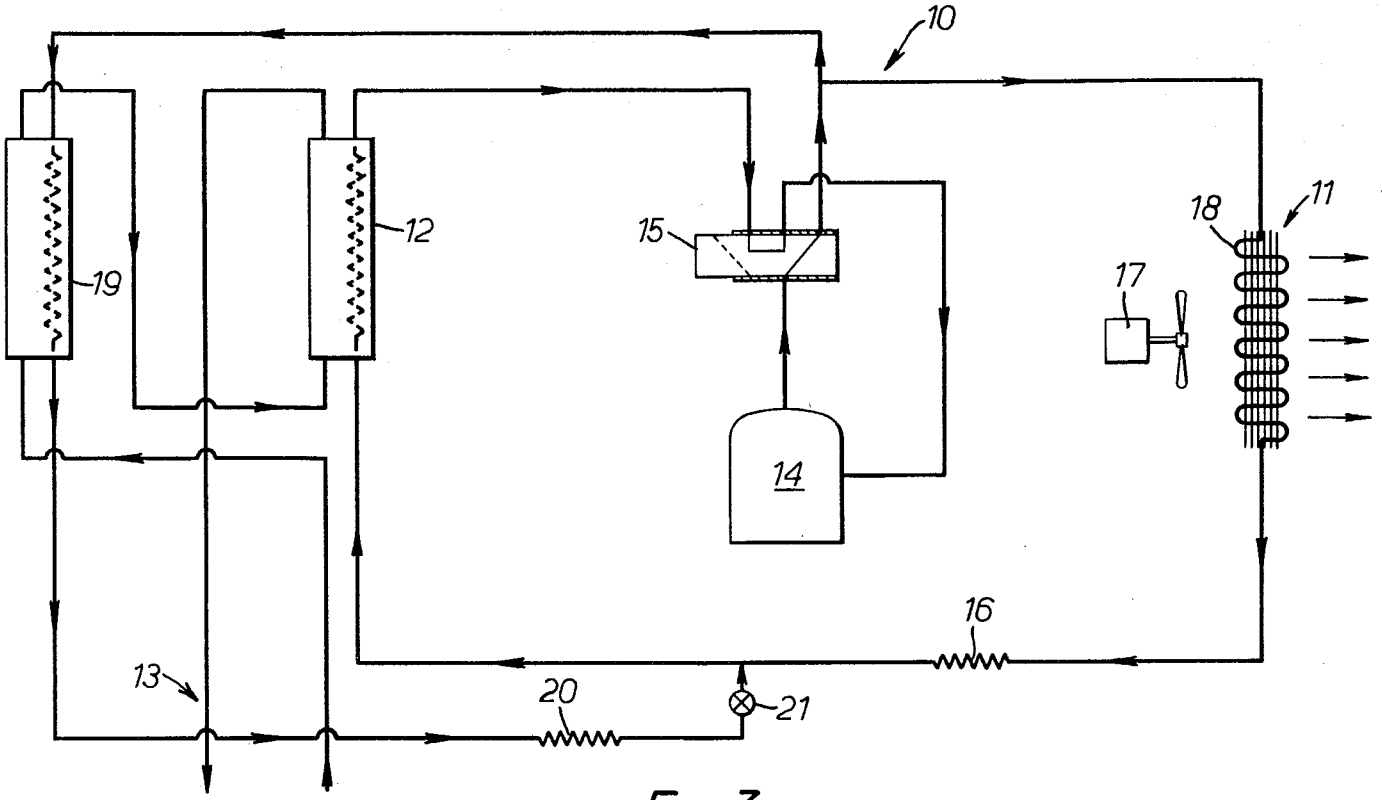
FIG. 3 is similar to FIG. 2 but showing the unit operating in an air-heating mode.

The form of air-conditioning unit shown in FIGS. 2 and 3 is similar to that shown in FIG. 1, but with a supplementary water/refrigerant heat exchanger 19 connected into the water circuit 13 in series with the heat exchanger 12. The refrigerant side of the heat exchanger 19 is connected between a point on the refregerant circuit between the heat exchanger 11 and the valve 15 and, via a supplementary capillary expansion tube 20 and a check valve 21, to a point on the refrigerant circuit between the heat exchanger 12 and the capillary expansion tube 16. The check valve 21 is arranged such that refrigerant flow through the supplementary water/refrigerant heat exchanger 19 is only possible during operation of the air-conditioning unit in an air-heating mode.

Thus, in an air-cooling mode of operation of the air conditioning unit (FIG. 2), the system 10 functions in the same manner as described with reference to the form of unit shown in FIG. 1 except that water in the water circuit also passes through the heat exchanger 19 but without affecting the operation of the system 10. The components of the system 10 other than the heat exchanger 19 are matched to give maximum efficiency during air-cooling.

During the air-heating mode of operation of the air-conditioning unit (FIG. 3), the heat exchanger 19 is connected into the refrigerant circuit and is sized to reject back into the water circuit 13 an amount of energy corresponding to the heat of compression of the compressor 14. As a result, the air/refrigerant heat exchanger 11 is only required to pass to air to be conditioned the same amount of heat as that exchanger transfers from the air to the refrigerant during the air-cooling mode of operation of the air-conditioning unit.

The heat rejected to the water circuit 13 through the heat exchanger 19 results in the water temperature being raised by an amount equivalent to the heat of compression. Theinterconnection of the heat exchangers 12 and 19 is such that water heated in the exchanger 19 is fed to the exchanger 12.

Typical operating temperatures for the water circuit 13 for heating of air from 68° F. to 105° F. are water in at 75° F., water out of the exchanger 19 at 78° F. and water out of the exchanger 12 at 65° F.

From the foregoing it will be appreciated that the provision of the suplementary water/refrigerant heat exchanger 19 results in the ratio of the amounts of heat being transferred through the exchangers 11 and 12 is approximately the same for both air-cooling and air-heating modes of operation of the air-conditioning unit. Thus the efficiency of the system 10 is maximised for both modes of operation. Further, an improved power factor is achieved for the compressor 14 during the air-heating mode and the operating head pressure is the same for both air-heating and air-cooling enabling a lower setting for a high-pressure cut-out provided in the refrigerant circuit.

Another result of the incorporation of the supplementary heat exchanger 19, is that on reduced heating air output by fan speed reduction, (that is, as the air flow volume is reduced) the refrigerant head pressure will rise, allowing the supplementary heat exchanger 19 to operate more efficiently and thus reject more energy to the water circuit 13.

Further, the frequency of cleaning of air filters of the unit will be reduced due to the fact that, as the filters become dirty thus reducing the air flow, a small increase in the refrigerant head pressure will cause the efficiency of the supplementary heat exchanger 19 to increase, thus creating a self-regulating effect to maintain the head pressure at an absolute minimum as the filters become more and more blocked.

Another result of providing the heat exchanger 19 is that the super-heated refrigerant discharge temperatures from the compressor are kept to an absolute minimum, thus ensuring that the compressor motor temperature is maintained at a minimum, resulting in a longer operating life of the motor windings (where an electric motor is used), motor bearings and the moving parts of the compressor. Furthermore, it has been found that a larger range of water circuit temperatures are possible than with previous comparable units without affecting the performance or safety of the unit, (thus, typically, the present unit can operate with a water temperature range of from 45° F. to 115° F. as compared with 60° F. to 95° F.).

Figure 4:
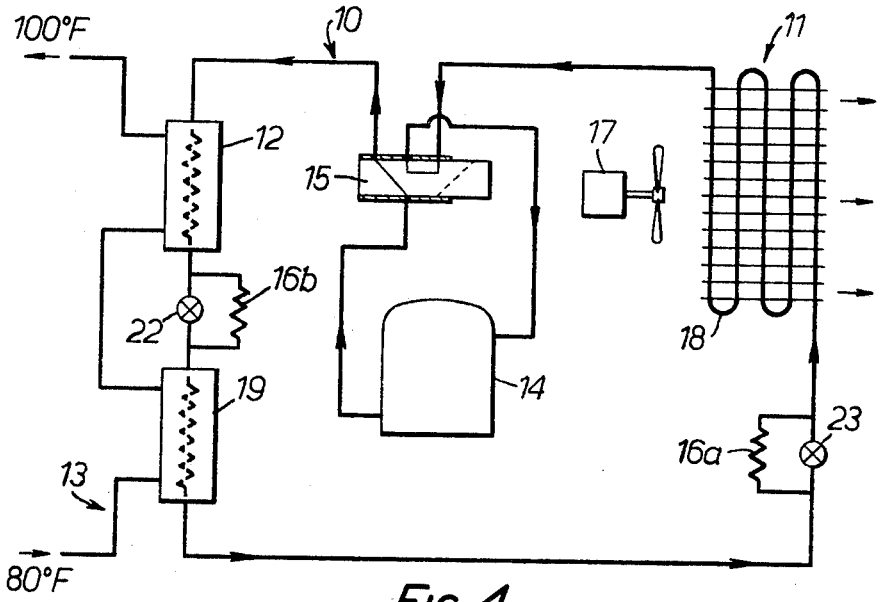
FIG. 4 is a diagram of a second form of the air-conditioning unit embodying the invention, operating in an air-cooling mode.
Figure 5:
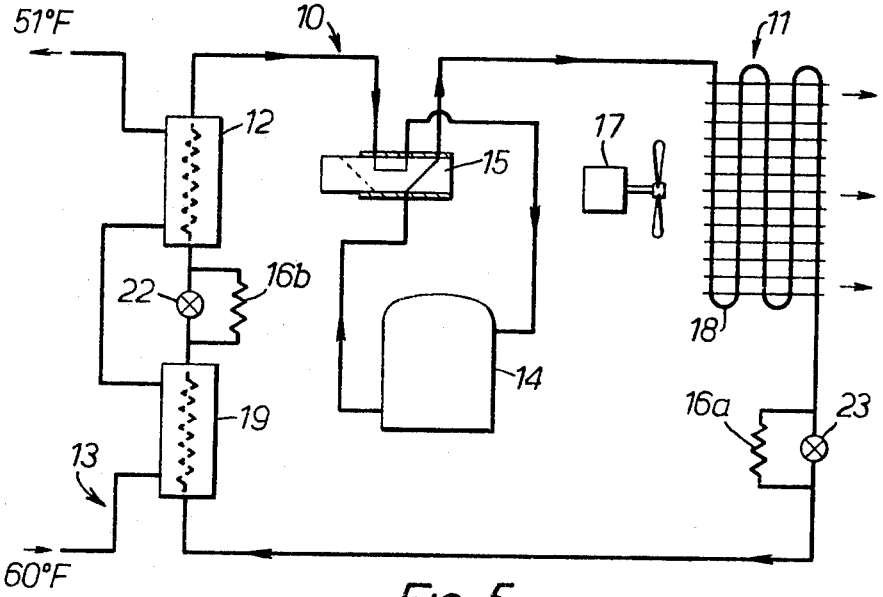
FIG. 5 is similar to FIG. 4, but showing the unit operating in an air-heating mode.

In the air-conditioning unit shown in FIGS. 2 and 3 the supplementary water/refrigerant heat exchanger 19 is arranged for parallel connection on its refrigerant side with the main water/refrigerant heat exchanger 12. However, it is also possible to connect the supplementary exchanger 19 in series on its refrigerant side with the main exchanger 12 as shown in FIGS. 4 and 5. In the form of air-conditioning unit shown in these Figures the compressor 14, the flow-reversing valve 15, the air/refrigerant heat exchanger 11, and the fan 17 are arranged as for the unit of FIGS. 2 and 3. The main and supplementary water/refrigerant heat exchangers 12 and 19 are connected in series on their water side.

The series interconnection of the exchangers 12 and 19 on their refrigerant sides is effected via a non-return valve 22 paralleled by a capillary expansion tube **16*b*, the arrangement of the valve 22 being such that during operation of the unit in an air cooling mode, the valve 22 is open and bypasses the expansion tube 16*b*. The supplementary exchanger 19 is connected to the air/refrigerant exchanger 11 via a non-return valve 23 paralleled by a capillary expansion tube 16*a*, the valve 23 being so arranged that during the air heating mode of operation of the unit the valve 22 is open bypassing the expansion tube 16*a*. The valves 22 and 23 are closed respectively during the air cooling and air heating modes of unit operation. It can thus be seen that the expansion tubes 16*a* and 16*b*** are operative respectively only during air cooling or air heating.

During air cooling (FIG. 4), the water/refrigerant heat exchangers 12 and 19 both serve to reject heat to the water circuit 13. However, during air heating (FIG. 5), the exchanger 12 serves to pass heat from the water circuit 13 to the refrigerant while the supplementary exchanger 19 continues to reject heat from the refrigerant to the water circuit 13, this being due to the positioning of the expansion tube **16*b* in the refrigerant circuit between the exchangers 19 and 12. Such an arrangement allows the heat exchangers 11 and 12 to operate at maximum efficiency during both air heating and air cooling as discussed in relation to the unit shown in FIGS. 2 and 3. Other of the advantages discussed in relation to the unit shown in FIGS. 2 and 3 are also generally achievable by the arrangement of the supplementary exchanger 19 as shown in FIGS. 4 and 5**.

From the foregoing, it will be appreciated that the purpose of the supplementary exchanger 19 (whatever its precise connection arrangement into the air-conditioning unit) is to give differing water/refrigerant heat transfer characteristics for the air heating and cooling modes of unit operation, and thereby enable the optimal operation of the exchanger 11 and 12.

Where a number of air-conditioning units are incorporated in a multi-zone air-conditioning application with their water circuits connected in parallel to be fed with water from a boiler as described in British Pat. No. 1,194,472, the boiler capacity required will be reduced by the provision of supplementary heat exchangers 19 in each unit.

I claim:

1. A reversible cycle unit for air conditioning a room in heating and cooling cycles, the unit receiving water as a heat source and as a heat sink and comprising:

a room heat exchanger for location in a room to heat or cool the room by the respective condensation or evaporation by air in the room of a refrigerant passing through the room heat exchanger, a first water heat exchanger connected in a closed refrigerant conveying circuit with the room heat exchanger and also recieving water for heat exchange with the refrigerant to condense the refrigerant in the cooling cycle and to evaporate the refrigerant in the heating cycle, a compressor arranged in the refrigerant circuit in the path of the refrigerant from the room heat exchanger to the first water heat exchanger, in the cooling cycle, and for driving the refrigerant around the circuit and heating the refrigerant during compression, reversing valve means associated with the compressor for reversing the direction of flow of the refrigerant around the circuit to change the heating system from the cooling cycle to the heating cycle, expansion means arranged before the room heat exchanger in the path of the refrigerant from the first water heat exchanger to the room heat exchanger, in the cooling cycle, a second water heat exchanger connected in the refrigerant circuit in the path of the refrigerant from the compressor to the first water heat exchanger, in the heating cycle, and, in the heating cycle, for receiving the water for heat exchange with the refrigerant to condense the refrigerant and to heat the water, a water outlet to the second water heat exchanger, and a water inlet to the first water heat exchanger connected to the water outlet of the second water heat exchanger whereby, in the heating cycle, heat extracted from the refrigerant in the second water heat exchanger and transferred to the water to heat the water, is passed to the first water heat exchanger to evaporate the refrigerant.

2. A reversible cycle unit according to claim 8, in which the second water heat exchanger is connected in the refrigerant circuit in parallel with the room heat exchanger and the expansion means, second expansion means being provided in the path of the refrigerant from the second water heat exchanger to the first water heat exchanger, in the heating cycle.

3. A reversible cycle unit according to claim 2 including a check valve for allowing refrigerant flow through the second water heat exchanger only during the heating cycle.

4. A reversible cycle unit according to claim 8 in which the second water heat exchanger is connected in the refrigerant circuit in series with the room heat exchanger in the path of the refrigerant from the room heat exchanger to the first water heat exchanger, in the heating cycle, second expansion means being arranged in the path of the refrigerant from the second water heat exchanger to the first water heat exchanger, in the heating cycle, and valve means for by-passing the first mentioned expansion means in the heating cycle and for by-passing the second expansion means in the cooling cycle.

5. A reversible cycle unit according to claim 8, in which the second water heat exchanger is arranged to return to the water during the heating cycle an amount of heat corresponding to the heat of compression of the compressor.

6. In a reversible-cycle closed-circuit refrigeration system using water as a heat source and as a heat sink and having a room heat exchanger for heating or cooling a room by the respective condensation or evaporation, by air in the room, of a refrigerant passing through the room heat exchanger, a first water heat exchanger connected in a closed refrigerant conveying circuit with the room heat exchanger and receiving water for heat exchange with the refrigerant to condense the refrigerant in a cooling cycle and to evaporate the refrigerant in a heating cycle, a compressor arranged in the refrigerant circuit in the path of the refrigerant from the room heat exchanger to the first water heat exchanger, in the cooling cycle, and for driving the refrigerant round the circuit and for heating the refrigerant during compression, the system being reversible to change the direction of flow around the circuit to change the heating system from the cooling cycle to the heating cycle, and expansion means arranged before the room heat exchanger in the path of the refrigerant from the water heat exchanger to the room heat exchanger, in the cooling cycle, the improvement comprising:

a second water heat exchanger connected in the refrigerant circuit in the path of the refrigerant from the compressor to the first water heat exchanger, in the heating cycle, and for receiving the water for, in the heat cycle, heat exchange with the refrigerant to condense the refrigerant and to heat the water, a water outlet to the second water heat exchanger, and a water inlet to the first water heat exchanger connected to the water outlet of the second water heat exchanger whereby, in the heating cycle, heated water from the second water heat exchanger is passed to the first water heat exchanger to evaporate the refrigerant.

* * * * *